US008915616B2

(12) United States Patent
Jeon et al.

(10) Patent No.: US 8,915,616 B2
(45) Date of Patent: Dec. 23, 2014

(54) LIGHTING APPARATUS HAVING A DRAIN STRUCTURE

(75) Inventors: Yongseog Jeon, Seoul (KR); Jinsung Kwak, Seoul (KR); Yongjin Kim, Seoul (KR); Jongkyo Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 196 days.

(21) Appl. No.: 13/426,961

(22) Filed: Mar. 22, 2012

(65) Prior Publication Data

US 2013/0148360 A1 Jun. 13, 2013

(30) Foreign Application Priority Data

Dec. 13, 2011 (KR) ..... 10-2011-0133566

(51) Int. Cl.
*F21V 29/00* (2006.01)

(52) U.S. Cl.
USPC ..... 362/294; 362/249.02; 362/362; 362/373

(58) Field of Classification Search
CPC ..... F21S 8/00–8/086; F21V 29/004; F21V 29/2243; F21V 31/03; F21Y 2101/02; F21W 2131/03
USPC ..... 362/294, 362, 373
See application file for complete search history.

(56) References Cited

U.S. PATENT DOCUMENTS

| | | | | |
|---|---|---|---|---|
| 7,420,811 | B2 * | 9/2008 | Chan | 361/709 |
| 7,837,362 | B2 * | 11/2010 | Zhang | 362/373 |
| 7,988,341 | B2 * | 8/2011 | Chen | 362/373 |
| 2006/0250803 | A1 * | 11/2006 | Chen | 362/373 |
| 2009/0034257 | A1 * | 2/2009 | Liu et al. | 362/252 |
| 2009/0168416 | A1 * | 7/2009 | Zhang et al. | 362/234 |
| 2009/0213588 | A1 * | 8/2009 | Manes | 362/235 |
| 2009/0310381 | A1 * | 12/2009 | Chang et al. | 362/555 |
| 2011/0222284 | A1 * | 9/2011 | Kong et al. | 362/249.02 |

FOREIGN PATENT DOCUMENTS

| | | | |
|---|---|---|---|
| JP | 2011-134517 | A | 7/2011 |
| KR | 20-0183297 | Y1 | 5/2000 |
| KR | 20-0447650 | Y1 | 2/2010 |
| KR | 10-1033874 | B1 | 5/2011 |
| KR | 10-1114510 | B1 | 2/2012 |
| KR | 10-0998424 | B1 | 12/2012 |

OTHER PUBLICATIONS

Machine English translation of JP 2011134517 to Hirai.*

* cited by examiner

*Primary Examiner* — Sikha Roy
(74) *Attorney, Agent, or Firm* — Ked & Associates, LLP

(57) ABSTRACT

A lighting apparatus is disclosed. The lighting apparatus has a drain structure of guiding water introduced through an assembly clearance to discharge the water to the outside and improves waterproof performance.

17 Claims, 10 Drawing Sheets

(a)

(b)

(a)

(b)

(a)

(b)

LIGHTING APPARATUS HAVING A DRAIN STRUCTURE

This application claims the benefit of Korean Patent Application No. 10-2011-0133566, filed on Dec. 13, 2011, which is hereby incorporated by reference as if fully set forth herein.

BACKGROUND OF THE INVENTION

1. Field of the Invention

The present invention relates to a lighting apparatus, and more particularly, to a lighting apparatus which has a drain structure of guiding water introduced through an assembly clearance to discharge the water to the outside and improves waterproof performance.

2. Discussion of the Related Art

In general, as light sources used in lighting, an incandescent lamp, a discharge lamp, a fluorescent lamp, etc. are mainly used for various purposes, such as for home, sightseeing and industrial use.

From among the above light sources, a resistive light source, such as an incandescent lamp, has low efficiency and generates a large amount of heat, a discharge lamp causes high costs and consumes high voltage, and a fluorescent lamp causes environmental problems due to use of mercury.

In order to solve the above drawbacks of the light sources, concern about a lighting apparatus using light emitting diodes (LEDs) having many advantages, such as high efficiency, diversity in color and autonomy in design, has increased.

An LED is a semiconductor device which emits light when voltage in the forward direction is applied to the device, and has a long lifespan, low power consumption and electrical, optical and physical characteristics suited to mass production, thus rapidly substituting for incandescent and fluorescent lamps. Further, the LED is rapidly applied to a lamp apparatus, such as a streetlamp, a guard lamp, a park lamp or a crime prevention lamp.

Such a lamp apparatus is installed outdoors under the condition that the lamp apparatus is hung on a column member, and needs to assure high durability and stable operability with respect to external environments, such as rain or snow.

Particularly, if it rains, when various electronic parts are not operated due to water introduced into the lamp apparatus through an assembly clearance, and if the introduced water is not discharged to the outside, the inside of the lamp apparatus is filled with water. Therefore, the lamp apparatus installed outdoors requires a drain structure and a waterproof structure in order to increase product reliability.

SUMMARY OF THE INVENTION

Accordingly, the present invention is directed to a lighting apparatus that substantially obviates one or more problems due to limitations and disadvantages of the related art.

An object of the present invention is to provide a lighting apparatus which has a drain structure of guiding water introduced through an assembly clearance to discharge the water to the outside.

Another object of the present invention is to provide a lighting apparatus which protects various electronic products arranged within the lighting apparatus from water introduced through an assembly clearance.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a light emitting unit including an LED module, a heat sink arranged at the rear of the LED module, and a light transmitting member arranged in front of the LED module, a housing provided with a first opening in which the light transmitting member is located and a second opening in which the heat sink is located, and an electronic module arranged within the housing to supply power to the LED module.

Here, water introduced into the housing through the second opening is discharged to the outside of the housing through a boundary portion between the light transmitting member and the first opening.

The heat sink may include a main body having a recess, and a plurality of radiation fins protruding from the rear part of the main body, the LED module may be disposed in the recess, and the light transmitting member may surround the recess.

The light transmitting members may include a plurality of concentration lenses.

The housing may include a first space part in which the light emitting unit is arranged and a second space part in which the electronic module is arranged, and a wall surrounding the electronic module may be provided in the second space part.

Water introduced into the second space part may flow to a space between the wall and the housing.

The housing may include a first body on which the light emitting unit is arranged and the wall is provided, and a second body surrounding the electronic module and arranged at a position opposite the wall.

The second body may be rotatably mounted on the first body.

Respective areas forming the first space part and the second space part of the first body may be inclined in different directions.

A groove part into which a free terminal of the wall is inserted may be formed on the second body.

The electronic module may be arranged so as not to overlap with the first opening and the second opening.

The lighting apparatus may further include a cover member surrounding the second opening and provided with a plurality of flow holes.

The lighting apparatus may further include a cable electrically connecting the LED module of the light emitting unit and the electronic module, and a first socket screw-connected to the heat sink may be provided at one end of the cable.

The cable and the LED module may be electrically connected within the heat sink.

A through hole may be formed on the wall, and a second socket screw-connected to the through hole may be provided at the other end of the cable.

The lighting apparatus may further include a support member to locate the housing in a lighting space, and a holder into which the support member is inserted, the holder being arranged within the housing.

The electronic module may be electrically connected to an external power supply unit through a power cable passing through the holder and discharged to the outside.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
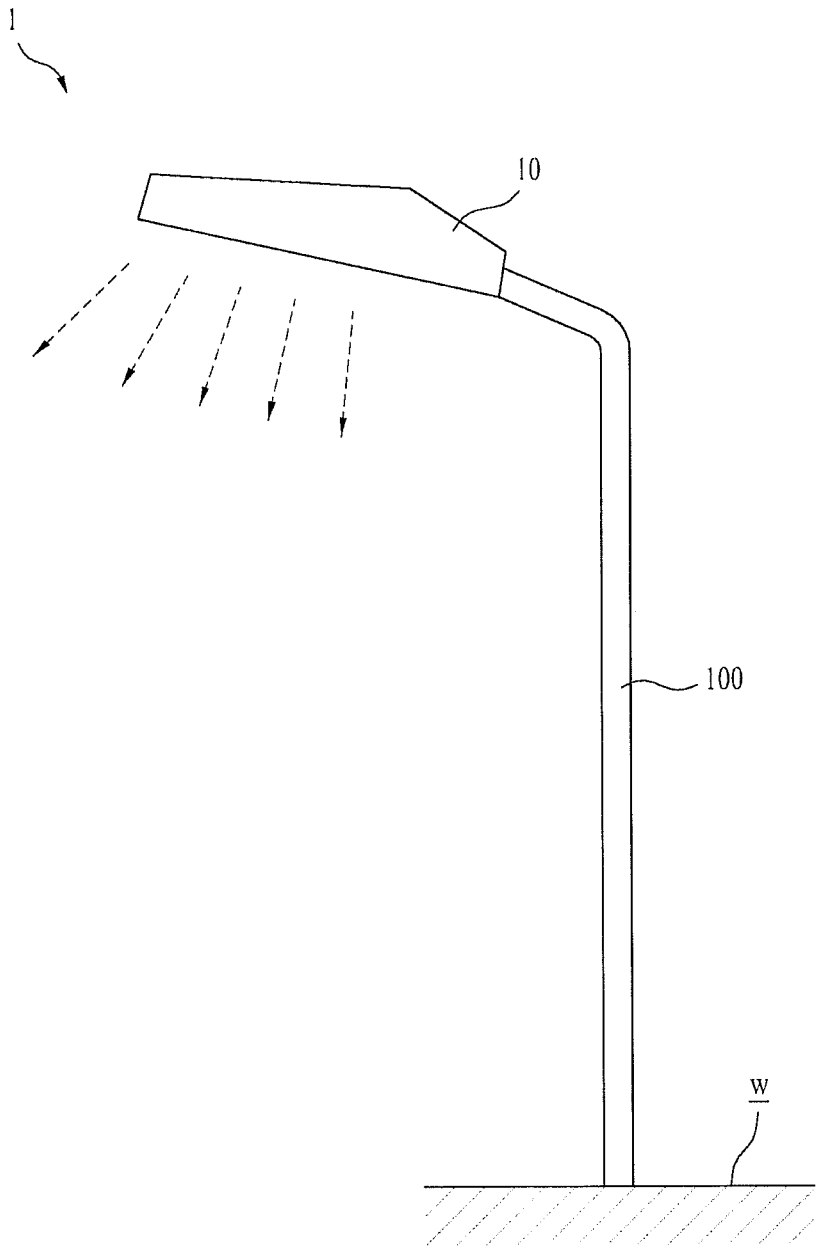
FIG. 1 is a schematic view illustrating the mounted state of a lighting apparatus in accordance with one embodiment of the present invention.

Hereinafter, a lighting apparatus in accordance with one embodiment of the present invention will be described in detail with reference to the accompanying drawings. The accompanying drawings are exemplarily provided only to describe the present invention in more detail, but do not limit the technical scope of the present invention.

Wherever possible, the same reference numbers will be used throughout the drawings to refer to the same or like parts, and a repetitive description thereof will be omitted. In the drawings, the size and shape of each element may be exaggerated or reduced for convenience of description and clarity.

Further, although terms including ordinal numbers, such as first, second, etc., may be used to describe various elements, these terms do not limit the elements, but are used only to discriminate one element from other elements.

Figure 2:
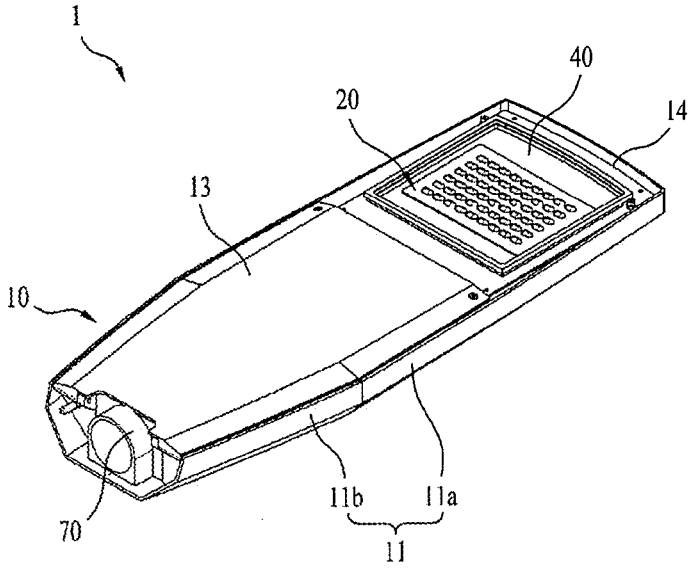
FIGS. 2(*a*) and 2(*b*) are perspective views of the lighting apparatus in accordance with the embodiment of the present invention.
Figure 2:
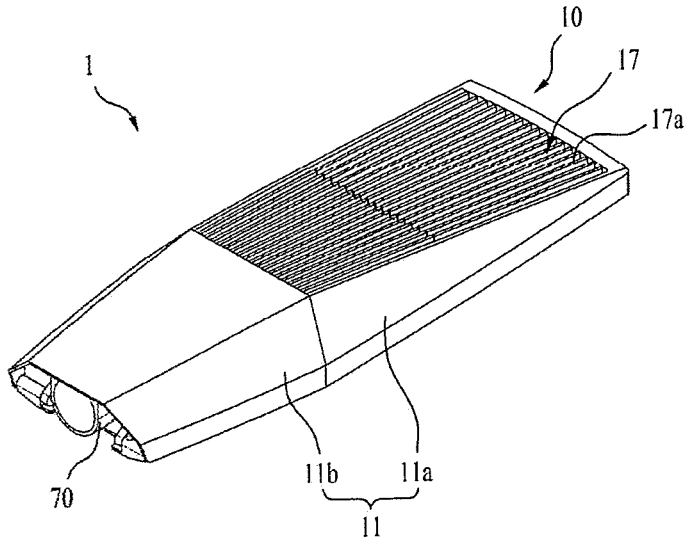

FIG. 1 is a schematic view illustrating the mounted state of a lighting apparatus 1 in accordance with one embodiment of the present invention, and FIGS. 2(*a*) and 2(*b*) are perspective views of the lighting apparatus 1 in accordance with the embodiment of the present invention, and more particularly, FIG. 2(*a*) is a perspective view illustrating the front surface of the lighting apparatus 1 and FIG. 2(*b*) is a perspective view illustrating the rear surface of the lighting apparatus 1.

The lighting apparatus 1 in accordance with the embodiment of the present invention may include all lamp apparatuses, such as a streetlamp, etc., and all lighting apparatuses installed outdoors, and for convenience of description, a streetlamp will be exemplarily described as the lighting apparatus 1.

The lighting apparatus 1 in accordance with the embodiment of the present invention includes a light emitting unit 20 including an LED module 21, a heat sink 30 arranged at the rear of the LED module 21 and a light transmitting member 40 arranged in front of the LED module 21*a*, a housing 10 provided with a first opening 15 in which the light transmitting member 40 is located and a second opening 16 in which the heat sink 30 is located, and an electronic module 50 arranged within the housing 10 to supply power to the LED module 21.

Here, water introduced into the housing 10 through the second opening 16 is discharged to the outside of the housing 10 through a boundary portion between the light emitting member 40 and the first opening 15.

Hereinafter, respective constituent members of the lighting apparatus 1 will be described in detail with reference to the accompanying drawings.

With reference to FIG. 1, the lighting apparatus 1 may include the housing 10 to accommodate the light emitting unit 20, and a support member 100 to locate the housing 10 within a lighting space.

The support member 100 may have a reversed L-shape or an l-shape, and may substantially include an arm part parallel with a mounting surface W and a pole part perpendicular to the mounting surface W. A holder 70 inserted into a partial region of the support member 100 may be arranged within the housing 10. The holder 70 may have a hollow cylindrical shape.

Figure 3:
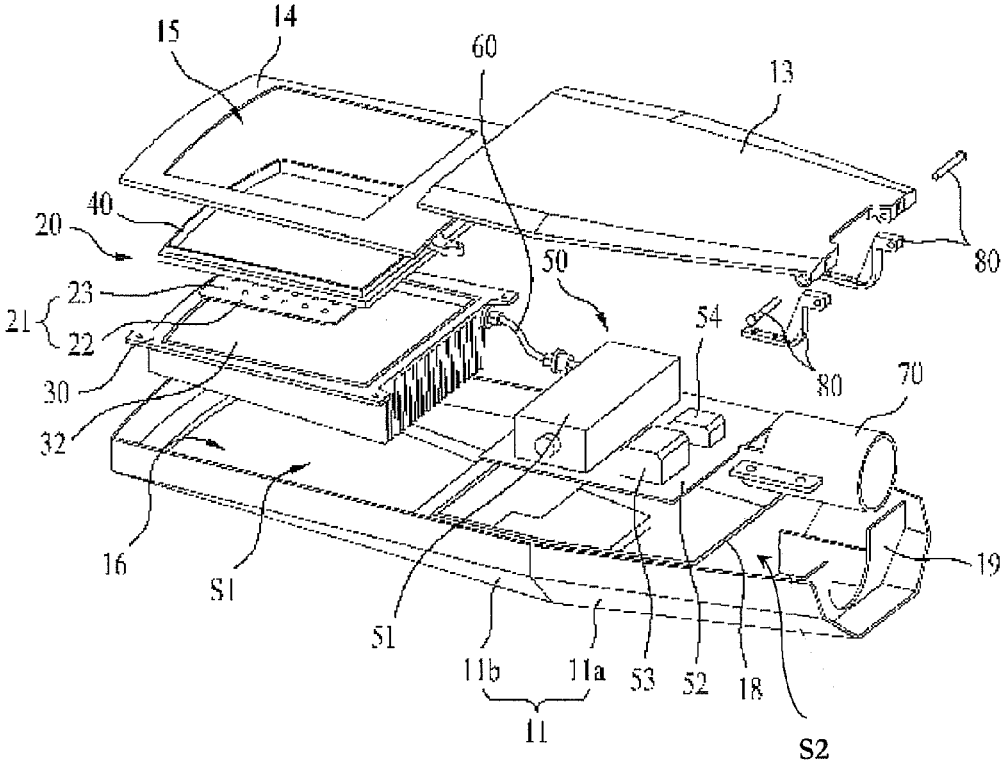
FIG. 3 is an exploded perspective view of the lighting apparatus in accordance with the embodiment of the present invention.

FIG. 3 is an exploded perspective view of the lighting apparatus in accordance with the embodiment of the present invention.

With reference to FIGS. 2(*a*) and 2(*b*) and FIG. 3, the light emitting unit 20 includes the LED module 21, the heat sink arranged at the rear of the LED module 21, and the light transmitting member 40 arranged in front of the LED module 21*a*, and the LED module 21 includes a substrate 22 and a plurality of LEDs 23 mounted on the substrate 22.

The heat sink 30 serves to dissipate heat generated from the LED module 21 to the outside, and may be formed of a metal having high thermal conductivity and high durability. Further, the heat sink 30 may include a main body 31 provided with a recess 32, and a plurality of radiation fins 33 protruding from the rear part of the main body 31.

The heat sink 30 may have various shapes, and for example, the main body 31 may have a plate shape having a designated thickness, and the recess 32 may be formed on the front surface of the main body 31 to have a designated depth or be formed such that the bottom surface of the recess 32 has a designated inclination angle.

Here, the LED module 21 is arranged in the recess 32, and the light transmitting member 40 surrounds the LED module 21 and the recess 32. The inner surface of the recess 32 may have a stepped structure such that the LED module 32 is separated from the bottom surface of the recess 32 by a designated interval.

The light transmitting member 40 emits light irradiated from the LED module 21 to the lighting space, may be formed of a light transmitting resin, and may include a diffusion member to diffuse the light irradiated from the LED module 21 and a plurality of concentration lenses to guide the light irradiated from the LED module 21 to emit the light to a specific area.

Further, in order to increase waterproof performance of the light emitting unit 20, the LED module 21 may be accommodated in a space formed by the recess 32 of the heat sink 30 and the light transmitting member 40, and the light transmitting member 40 may be fixed to the heat sink 30.

Here, in order to effectively intercept water introduced into the LED module 21 through the boundary portion between the light transmitting member 40 and the heat sink 30, a watertight member (not shown) formed of rubber or silicon may be arranged between the heat sink 30 and the light transmitting member 40, and the watertight member may have a ring shape.

Further, the lighting apparatus 1 includes the electronic module 50 arranged within the housing 10 to supply power to the LED module 21.

The electronic module 50 may include a converter 51 to convert external power, a surge protector 53 to protect the electronic module 50 from lightning, etc., a terminal block 54 to connect the converter 51 to an external power supply unit (not shown), and a mounting member 52 to respectively mount the converter 51, the surge protector 53 and the terminal block 54 thereon, and the mounting member 52 may have a plate shape.

The electronic module 50 may be arranged so as not to overlap with the first opening 15 and the second opening 16 of the housing 10. Such a structure may prevent water introduced into the first opening 15 from directly reaching the electronic module 50.

The housing 10 is provided with the first opening 10 in which the light transmitting member 40 is located and the second opening 16 in which the heat sink 30 is located.

The first opening 15 functions to pass light emitted from the light transmitting member 40, and the second opening 16 functions to allow external air to be introduced thereinto and discharged therefrom to dissipate heat from the heat sink 30.

The housing 10 may include a first space part S1 in which the light emitting unit 20 is arranged and a second space part S2 in which the electronic module 50 is arranged and, for example, the first space part S1 and the second space part S2 may be divided in the longitudinal direction of the housing 10.

In order to protect the electronic module 50 from water introduced into the housing 100, a wall 18 surrounding the electronic module 50 may be provided in the second space part S2 of the housing 10.

Further, a mounting part 19 to mount the holder 70 may be provided in the second space part S2.

The housing 10 may include a first body 11 on which the light emitting unit 20 is arranged and the wall 18 is provided and a second body 13 surrounding the electronic module 50 and arranged at a position opposite the wall 18. Here, the second body 13 may be rotatably mounted on the first body 11 via hinge devices 80.

Therefore, the lighting apparatus 1 in accordance with the embodiment of the present invention rotates the second body 13 with respect to the first body 11 to expose the electronic module 50, thereby allowing the electronic module 50 to be easily repaired or replaced.

Further, the second body 13 is provided with a groove part 13*a* into which a free terminal of the wall 18 is inserted, and in order to prevent water within the housing 10 from being transferred to the electronic module 50 through the boundary portion between the wall 18 and the second body 13, a watertight member may be arranged between the wall 18 and the groove part 13*a*.

Further, the housing 10 may include a third body 14 provided with the first opening 15, the third body 14 may be fixed to the first body 11, and the light emitting unit 20 may be easily repaired and replaced by separating the third body 14 from the first body 11.

Further, the first body 11 is divided into a first area 11*a* forming the first space part S1 and a second area lib forming the second space part S2, and the second opening 16 may be provided in the first area 11*a*.

Further, when the lighting apparatus 1 is installed under the condition that the body 10 is mounted on the support member 100, the first body 11 directly contacts rainwater, and may be formed in a streamline shape to guide such rainwater to the mounting surface W. For example, the first area 11*a* forming the first space part S1 of the first body 11 and the second area 11*b* forming the second space part S2 of the first body 11 may be inclined in different directions.

Through such an inclined structure or a streamlined shape, rainwater dropped to the first body 11 is rapidly guided to the mounting surface W.

The lighting apparatus 1 may further include a cover member 17 surrounding the second opening 16 and provided with a plurality of flow holes or slits 17*a*.

Heat generated from the LED module 21 is dissipated to the outside through heat exchange between external air introduced through the flow holes 17*a* of the cover member 17 and the radiation fins 33 of the heat sink 30.

Water introduced through the flow holes 17*a* of the cover member 17 due to rain or snow may dissipate heat generated from the heat sink 30, but may cause defects in the electronic module 50 and the LED module 21.

The housing 10 has a structure in which a plurality of bodies is assembled, and thereby, water may be introduced into the housing 10 through the boundary portions between the respective bodies.

Hereinafter, a drain structure of guiding water introduced into the housing 10 to the outside of the housing 10 will be described in detail with reference to the accompanying drawings.

Figure 4:
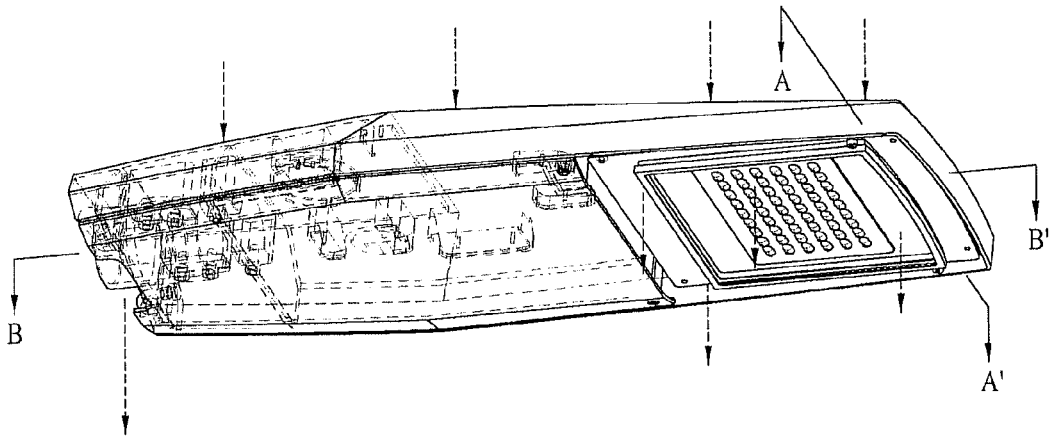
FIG. 4 is a perspective view illustrating a drain structure of the lighting apparatus in accordance with the embodiment of the present invention.
Figure 5:
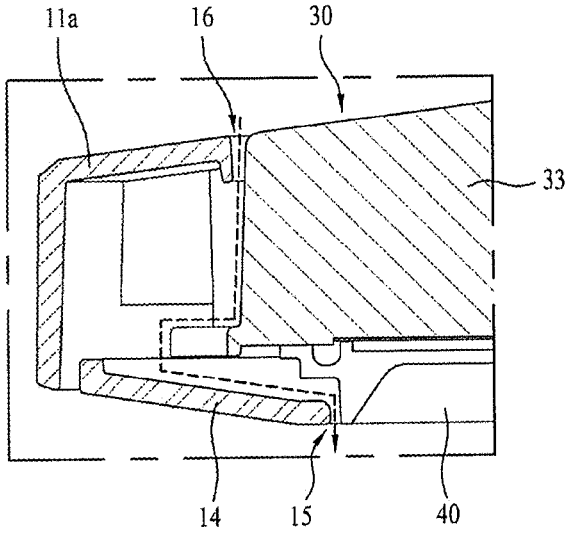
FIGS. 5(*a*) and 5(*b*) to FIG. 7 are views illustrating the drain structure of the lighting apparatus in accordance with the embodiment of the present invention.
Figure 5:
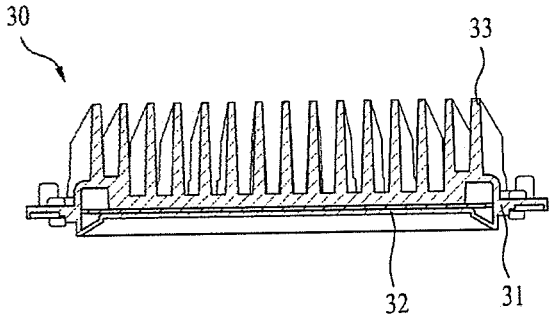
Figure 7:
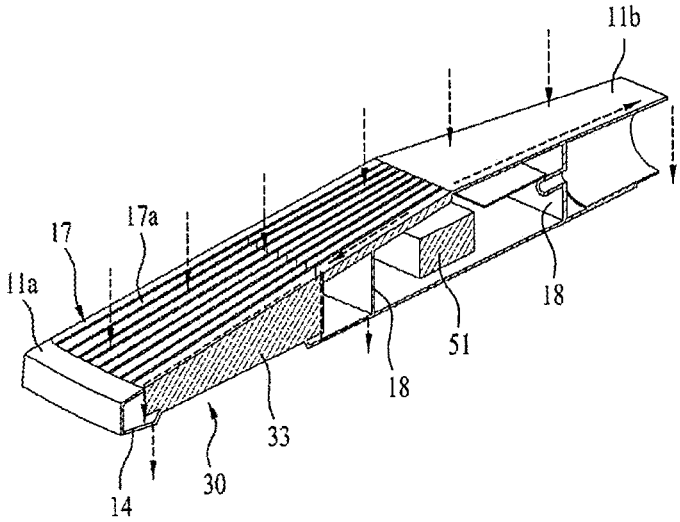

FIG. 4 is a perspective view illustrating the drain structure of the lighting apparatus in accordance with the embodiment of the present invention, and FIGS. 5(*a*) and 5(*b*) to FIG. 7 are views illustrating the drain structure of the lighting apparatus in accordance with the embodiment of the present invention. In more detail, FIGS. 5(*a*) and 5(*b*) are cross-sectional views taken along the line A-A' of FIG. 4, and FIG. 7 is a cross-sectional view taken along the ling B-B' of FIG. 4.

With reference to FIGS. 4, 5(*a*), 5(*b*) and 7, water may be introduced into the housing 10 through the boundary portion between the second opening 16 and the cover member 17 and/or the flow holes of the cover member 17.

Water introduced into the housing 10 through the second opening 16 is discharged to the outside of the housing 10 through the boundary portion between the light transmitting member 40 and the first opening 15. The size of the first opening 15 may be adjusted so as to use assembly tolerance between the light transmitting member 40 and the first opening 15 or to form a designated interval between the light transmitting member 40 and the first opening 15.

Specifically, water introduced into the housing 10 through the flow holes 17*a* or the second opening 16 flows into a space between the radiation fins 33 of the heat sink 30, moves along the surface of the light transmitting member 40, and is then discharged to the outside of the housing 10 through the boundary portion between the light transmitting member 40 and the first opening 15.

Here, in order to effectively intercept water introduced into the LED module 21 through the light transmitting member 40 and the heat sink 30, the watertight member (not shown) formed of rubber or silicon may be arranged between the heat sink 30 and the light transmitting member 40.

Therefore, the light transmitting member 40 is mounted on the heat sink 30 under the condition that the light transmitting member 40 surrounds the recess 32, and thus effectively intercepts water introduced into the LED module 21 arranged therein, thereby increasing waterproof performance.

Figure 6:
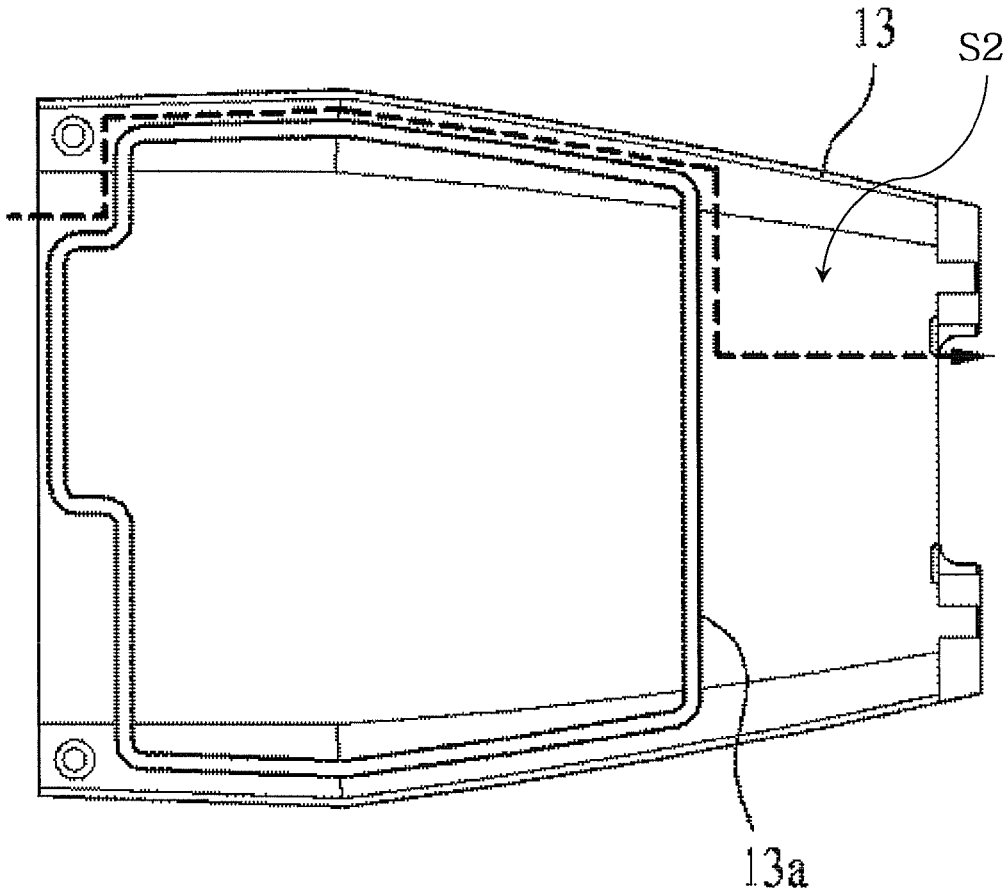

With reference to FIGS. 6 and 7, if the amount of water discharged through the boundary portion between the first opening and the light transmitting member 40 is greater than the amount of water introduced into the housing 10, the inside of the housing 10 may be filled with water.

Water flowing along the space between the radiation fins 33 of the heat sink 30 flows to the second space part S2. The water introduced into the second space part S2 moves toward the holder 70 while flowing along the space between the wall 18 and the housing 10. Thereafter, the water may be discharged to the outside along an opening of the area in which the holder 70 is mounted.

Since the free terminal of the wall 18 is inserted into the groove part 13*a*, the electronic module 50 is sealed within the second space part S2 by the wall 18, and since the watertight member is arranged between the wall 18 and the groove part 13*a* in order to effectively prevent water within the housing 10 from being transferred to the electronic module 50 through the boundary portion between the wall 18 and the second body 13, the waterproof effects of the electronic module 50 may be improved.

As described above, the lighting apparatus 1 in accordance with the embodiment of the present invention has a drain structure of guiding water introduced through an assembly clearance to discharge the water to the outside.

Further, in the lighting apparatus 1 in accordance with the embodiment of the present invention, the light emitting unit and the electronic module 50 have a structure having high water tightness.

Here, the LED module 21 of the light emitting unit 20 and the converter 51 of the electronic module 50 need to be electrically connected so as to supply power.

Hereinafter, a structure having excellent waterproof performance while electrically connecting the LED module 21 and the converter 51 will be described in detail with reference to the accompanying drawings.

Figure 8:
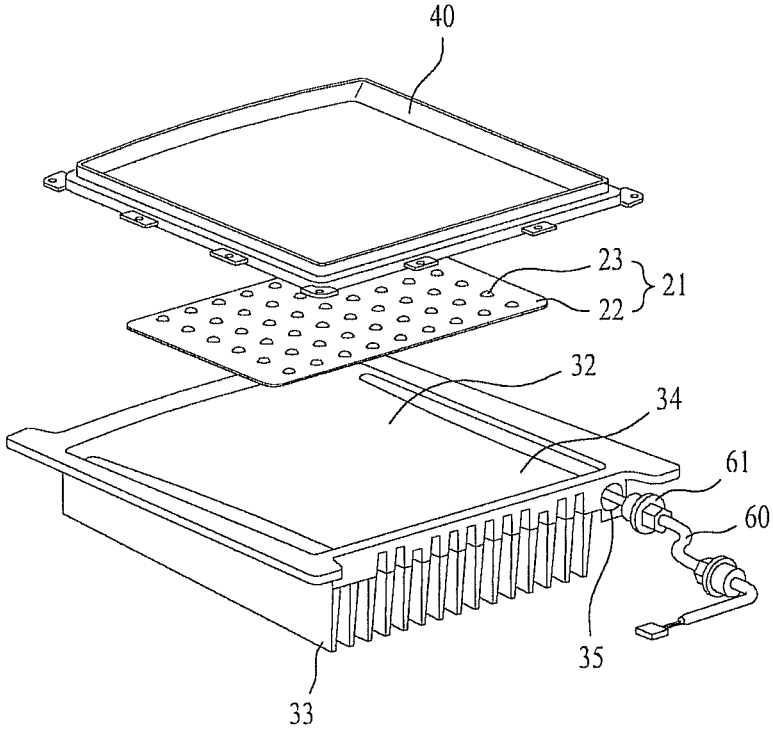
FIG. 8 is an exploded perspective view of a light emitting unit constituting the lighting apparatus in accordance with the embodiment of the present invention.
Figure 9:
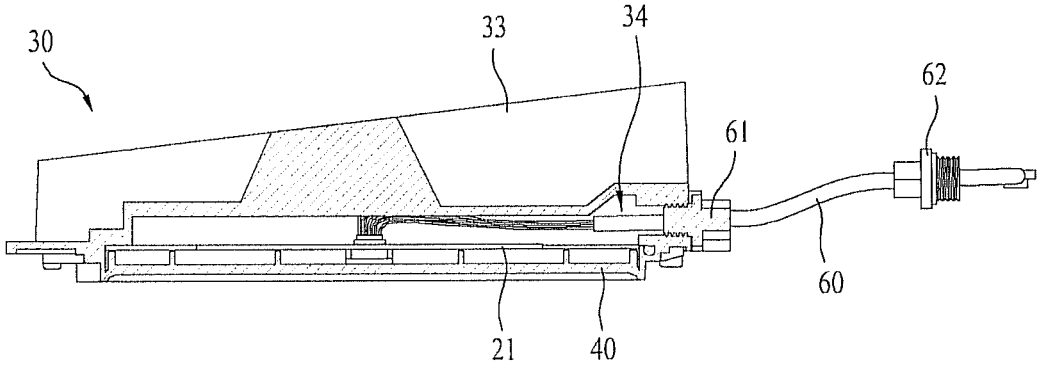
FIG. 9 is a cross-sectional view illustrating the inside of the light emitting unit constituting the lighting apparatus in accordance with the embodiment of the present invention.
Figure 10:
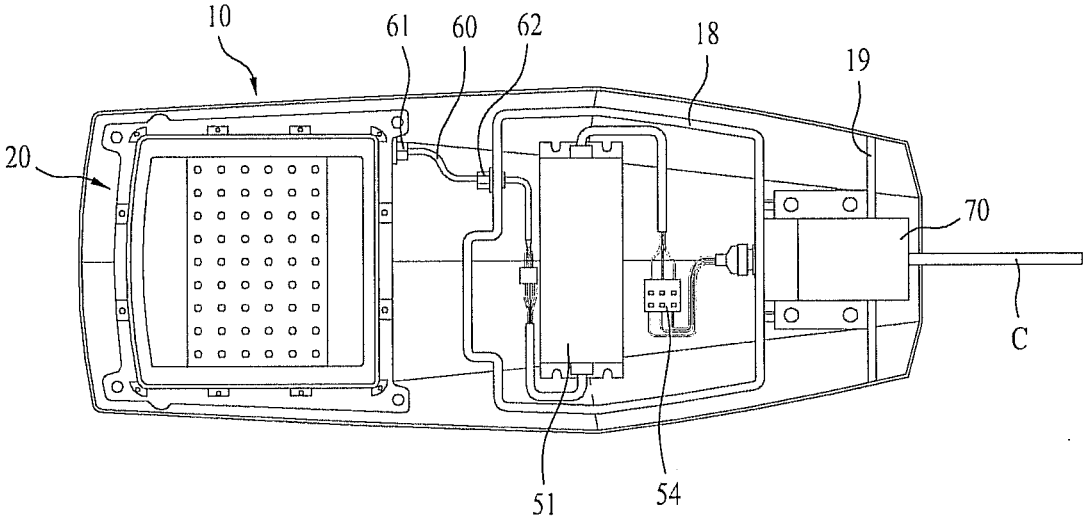
FIG. 10 is a plan view of the lighting apparatus in accordance with the embodiment of the present invention.

FIG. 8 is an exploded perspective view of the light emitting unit constituting the lighting apparatus in accordance with the embodiment of the present invention, FIG. 9 is a cross-sectional view illustrating the inside of the light emitting unit constituting the lighting apparatus in accordance with the embodiment of the present invention, and FIG. 10 is a plan view of the lighting apparatus in accordance with the embodiment of the present invention.

With reference to FIGS. 8 and 9, the lighting apparatus 1 may further include a cable 60 electrically connecting the LED module 21 of the light emitting unit 20 and the electronic module 50 (particularly, the converter 51), and a first socket 61 screw-connected to the heat sink 30 may be provided at one end of the cable 60.

Here, the cable 60 and the LED module 21 may be electrically connected to an inner space 34 of the heat sink 30.

As described above, the heat sink 30 includes the main body 31 provided with the recess 32, and the plural radiation fins 33 protruding from the rear part of the main body 31, the LED module 21 is arranged in the recess 32, and the light transmitting member 40 surrounds the recess 32. Therefore, the light emitting unit 20 has excellent waterproof performance.

Here, the LED module 21 is separated from the bottom surface of the recess 32 by a designated interval, and for this purpose, the inner surface of the recess 32 may have a stepped structure. The cable 60 and the LED module 21 may be electrically connected in the space 34 between the substrate 22 of the LED module 21 and the bottom surface of the recess 32.

Further, a through hole 35 connected to the space 34 between the substrate 22 of the LED module 21 and the bottom surface of the recess 32 may be formed on the heat sink 30, and the first socket 61 of the cable 60 may be screw-connected to the through hole 35.

That is, since the cable 60 and the LED module 21 are electrically connected in the space 34 between the substrate 22 of the LED module 21 and the bottom surface of the recess 32, the lighting apparatus 1 in accordance with the embodiment of the present invention has excellent waterproof performance.

With reference to FIG. 9, a through hole (not shown) may be formed on the wall 18, and a second socket 62 screw-connected to the through hole may be provided at the other end of the cable 60.

Therefore, since an electrical connection point between the converter 51 of the electronic module 50 and the cable 60 is located within the wall 18 and an electrical connection point between the LED module 21 and the cable 60 is located within the heat sink 30, the lighting apparatus 1 in accordance with the embodiment of the present invention has excellent waterproof performance.

The electronic module 50 may be electrically connected to an external power supply unit (not shown) through a power cable C passing through the holder 70 and discharged to the outside.

As apparent from the above description, a lighting apparatus in accordance with one embodiment of the present invention has a drain structure of guiding water introduced through an assembly clearance to discharge the water to the outside.

Further, the lighting apparatus in accordance with the embodiment of the present invention has excellent waterproof performance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lighting apparatus comprising:

a light emitting unit including an LED module, a heat sink arranged at the rear of the LED module, and a light transmitting member arranged in front of the LED module;

a housing having a first opening in which the light transmitting member is located and a second opening in which the heat sink is located; and an electronic module arranged within the housing to supply power to the LED module, wherein a gap is provided between the light transmitting member and the first opening to drain water introduced into the housing through the second opening to the outside of the housing, wherein the first opening is opposite to the second opening, wherein the heat sink includes a main body having a plurality of radiation fins protruding from the rear part of the main body, wherein the plurality of radiation fins extend toward the second opening to be exposed at the second opening of the housing, the plurality of radiation fins being arranged to form at least one channel that guides water into the housing through the second opening, wherein the light emitting unit is arranged in a first region of the housing and the electronic module is arranged in a second region of the housing, a wall surrounding the electronic module is provided in the second region and forming a space between the wall and the housing, and wherein the at least one channel on the heat sink communicates with the space in the second region such that water introduced into the second region flows through the space between the wall and the housing to drain out of the housing.

2. The lighting apparatus according to claim 1, wherein:

the main body has a recess;

the LED module is disposed in the recess; and the light transmitting member surrounds the recess.

3. The lighting apparatus according to claim 1, wherein the light transmitting members include a plurality of concentration lenses.

4. The lighting apparatus according to claim 1, wherein the housing includes:

a first body on which the light emitting unit is arranged and the wall is provided; and a second body surrounding the electronic module and arranged at a position opposite the wall.

5. The lighting apparatus according to claim 4, wherein the second body is rotatably mounted on the first body.

6. The lighting apparatus according to claim 4, wherein respective areas forming the first region and the second region of the first body are inclined in different directions.

7. The lighting apparatus according to claim 4, wherein a groove part into which a free terminal of the wall is inserted is formed on the second body.

8. The lighting apparatus according to claim 1, wherein the electronic module is arranged so as not to overlap with the first opening and the second opening.

9. The lighting apparatus according to claim 1, further comprising a cable electrically connecting the LED module of the light emitting unit and the electronic module, wherein a first socket screw-connected to the heat sink is provided at one end of the cable.

10. The lighting apparatus according to claim 9, wherein the cable and the LED module are electrically connected within the heat sink.

11. The lighting apparatus according to claim 9, wherein:

a through hole is formed on the wall; and a second socket screw-connected to the through hole is provided at the other end of the cable.

12. The lighting apparatus according to claim 1, further comprising:

a support member to locate the housing in a lighting space; and a holder into which the support member is inserted, the holder being arranged within the housing.

13. The lighting apparatus according to claim 12, wherein the electronic module is electrically connected to an external power supply unit through a power cable passing through the holder to the outside.

14. The lighting apparatus according to claim 1, wherein water introduced into the housing through the second opening flows into the space between the radiation fins of the heat sink, moves along the surface of the light transmitting member, and wherein water is drained out of the housing through a boundary portion between the light transmitting member and the first opening.

15. The lighting apparatus according to claim 1, wherein the first opening is provided on a lower side of the housing and the second opening is provided on an upper side of the housing opposite the first opening, and the heat sink is provided in the housing and exposed through the second opening.

16. The lighting apparatus according to claim 1, wherein the at least one channel guides water introduced into the housing through the second opening toward a gap between the light transmitting member and the housing in the first space part to be drained through the first opening.

17. A lighting apparatus comprising:

a light emitting unit including an LED module, a heat sink arranged at the rear of the LED module, and a light transmitting member arranged in front of the LED module;

a housing having a first opening in which the light transmitting member is located and a second opening in which the heat sink is located;

an electronic module arranged within the housing to supply power to the LED module, the electronic module surrounded by a wall that is provided a prescribed distance from the heat sink; and a cable that extends from the wall to the heat sink to electrically connect the LED module of the light emitting unit and the electronic module, wherein a gap is provided between the light transmitting member and the first opening to drain water introduced into the housing through the second opening to the outside of the housing, wherein the first opening is opposite to the second opening, wherein the heat sink includes a main body having a plurality of radiation fins protruding from the rear part of the main body, wherein the plurality of radiation fins extend toward the second opening, and wherein the cable includes a first socket screw provided at one end of the cable and a second socket screw provided at the other end of the cable, the first socket screw electrically connecting the cable to the LED module within the heat sink and the second socket screw electrically connecting the cable to the electronic module within the wall.

* * * * *